US005805535A

United States Patent [19]

Guyard et al.

[11] Patent Number: 5,805,535

[45] Date of Patent: Sep. 8, 1998

[54] MOVABLE SHUTTER FOR A WATCH

[75] Inventors: Jean-Pierre Guyard, Merey sous Montrond; Pierre LaBoue, Emagny, both of France

[73] Assignee: Fabrique de montres Delanteau SA, Switzerland

[21] Appl. No.: 762,437

[22] Filed: Dec. 9, 1996

[30] Foreign Application Priority Data

Dec. 20, 1995 [CH] Switzerland ..... 03621/95

[51] Int. Cl.[6] ..... G04B 37/00

[52] U.S. Cl. ..... 368/283; 368/282

[58] Field of Search ..... 368/280, 281–283

[56] References Cited

U.S. PATENT DOCUMENTS 3,964,802 6/1976 Pitner ..... 160/133
5,586,592 12/1996 McGregor ..... 160/133

FOREIGN PATENT DOCUMENTS 144054 10/1929 Switzerland ..... 368/283
649434 5/1985 Switzerland .

*Primary Examiner*—Bernard Roskoski

*Attorney, Agent, or Firm*—Ostrolenk, Faber, Gerb & Soffen, LLP

[57] ABSTRACT

The movable shutter device provided on a timepiece comprises stretchers in the form of oblong handles which are screwed onto a middle part of generally rectangular shape with flanks. The stretchers comprise a groove which is composed of a rectilinear portion followed on either side by a rounded portion, the latter giving on a groove which is formed by the surfaces of a protective plate connected to the back cover and by a flat portion of said back cover. The closed circuits formed by the grooves surround the middle part. The movable curtain formed by shutter axles which are interconnected on both sides by two rows of connecting links is slidable in said grooves by means of rollers made of rubies. In order to ensure that any intermediate position of the curtain between the two end positions is maintained, i.e. the completely open and the completely closed position, which are limited by a stop device, a brake device is provided which is accommodated in a hollow shutter axle, preferably near the first shutter axle having an actuating button, said brake device comprising an elastic member transmitting a thrust to the ruby rollers through brake axles. The protective plate may take the form of a grid or be perforated, in such a manner as to make particular effects produced by the passage of the movable shutter apparent.

9 Claims, 5 Drawing Sheets

MOVABLE SHUTTER FOR A WATCH

BACKGROUND OF THE INVENTION

The present invention refers to a movable shutter device, more particularly for a timepiece having a middle part (4) provided with a crystal and a back cover, the device comprising a protective plate, two lateral supports which extend in parallel to the 6:00–12:00 plane and are provided with a groove which is milled in their internal surface facing the crystal, and cylindrical shutter axles whose end portions are guided on either side in said supporting grooves and connected to each other on both sides by means of two adjacent rows of connecting links which are arranged on said axles, said two rows, i.e. the internal one and the external one, being offset with respect to each other at least one step, and each link uniting at least two adjacent shutter axles; the shutter formed by said axles being displaceable above the crystal due to said guiding of the axle ends, on one hand, in such a manner as to be able to cover said crystal or to leave it completely or partially visible and, on the other hand, slidable between the back cover and the protective plate, the maximum displacement being limited by a stop device consisting of cylinders which are similar or identical to the shutter axles, said stop device comprising an opening abutment and a closing abutment, the latter being capable of cooperating with a shutter button which is arranged on the first cylinder at the front of the movable shutter and allows to lock the latter in the closed position.

Such a device is described in Swiss Patent No. CH-649,434 to the applicant. According to this document, the device comprises two lateral supports which are parallel to the 6:00–12:00 plane and are soldered to the corresponding surfaces of a rectangular middle part of a watch, each of said supports having a closed groove extending around the intersection of said surface of the middle with the internal surface of the support. The shutter itself is formed of tubular elements which are connected to one another while the ends of these elements comprise pins which are guided in said grooves, the shutter thus being displaceable on the crystal. The means of the device allow a relatively flat construction, and it is particularly intended for an upper-range wristwatch.

However, this prior art shutter has two types of drawbacks which sensibly reduce its interest.

Actually, when the wearer of the watch actuates the shutter by means of the button which is mounted on the first of said tubular elements in order to completely or partially cover or uncover the crystal, the shutter often tends to be jammed or to get stuck, depending on the precision of its adjustment. In any case, due to a premature wear of the ends (above-mentioned pins 17 in CH-649,434 or rolls fitted thereon) of the tubular elements and of the support grooves, these drawbacks will occur more and more frequently.

On the other hand, the displacement of the shutter in one direction or another, according to the movements of the wrist, is not controllable unless said shutter is locked: either the pins or rolls slide in the grooves with a lot of play, so that undesired displacements will be frequent until the curtain is jammed; or said play is very small, so that the curtain will not be unduly displaced by the movements of the wrist, but it will be stuck even more quickly, especially if the elements sliding on each other are of gold.

In any case, it is apparent that the function of the cited prior art shutter is unsatisfactory.

SUMMARY OF THE INVENTION

Thus, it is the object of the present invention to eliminate the above-mentioned drawbacks, i.e., on one hand, to obtain a perfect and reliable sliding action of the curtain, so as to satisfy the highest demands of the customers and, on the other hand, correlatively to control said sliding action in such a manner that any undue displacement of the curtain is excluded. Since the shutter device is more particularly intended for an upper range watch, it appears that the search for solutions becomes even more difficult as specific requirements have to be taken into account besides the general demands of miniaturization (where the implementation of the same means generally involves increasing problems as its dimensions are reduced). In fact, at least two additional difficulties arise: the first one refers to the choice of materials, which cannot be arbitrary since certain rules have to be followed for this type of watch; the second one refers to the esthetic aspect since, while a perfect operation of the device is fundamental, it is equally important not only that its operation does not sacrifice the demands of that aspect but on the contrary, serves the latter while allowing to improve and vary the finishes at the lowest cost.

The object of the invention is attained by a movable shutter device wherein said supports are in the form of stretchers, said middle part comprises two lateral flanks which are parallel to the 6:00–12:00 plane, as well as two seats extending in the same direction, said stretchers being mounted onto the top of the middle part in said seats and fastened to the flanks of said middle by fastening means, and wherein the guiding groove milled in each stretcher is open and comprises a rectilinear portion which is followed on both sides by a respective circular portion which gives on a groove whose profile is at least analogous to the rectilinear portion of said groove, said profile being formed, on one hand, by the surfaces of the protective plate and, on the other hand, by a flat portion of the underside of the middle part which is opposed and parallel to the surface of the protective plate, by a movable shutter device wherein each one of said shutter axles is formed of a cylinder which is followed on either side by a connecting axle and by a bearing axle on which an independent roller of a noble material having a very high hardness and a very high self-lubrifying capacity is arranged, and by a movable shutter device wherein a brake device is provided which is accommodated in a hollow shutter axle.

BRIEF DESCRIPTION OF THE DRAWINGS

An embodiment of the device of the invention will now be described as a non-limiting example with reference to the appended drawings, wherein.

DETAILED DESCRIPTION OF THE INVENTION

Figure 1:
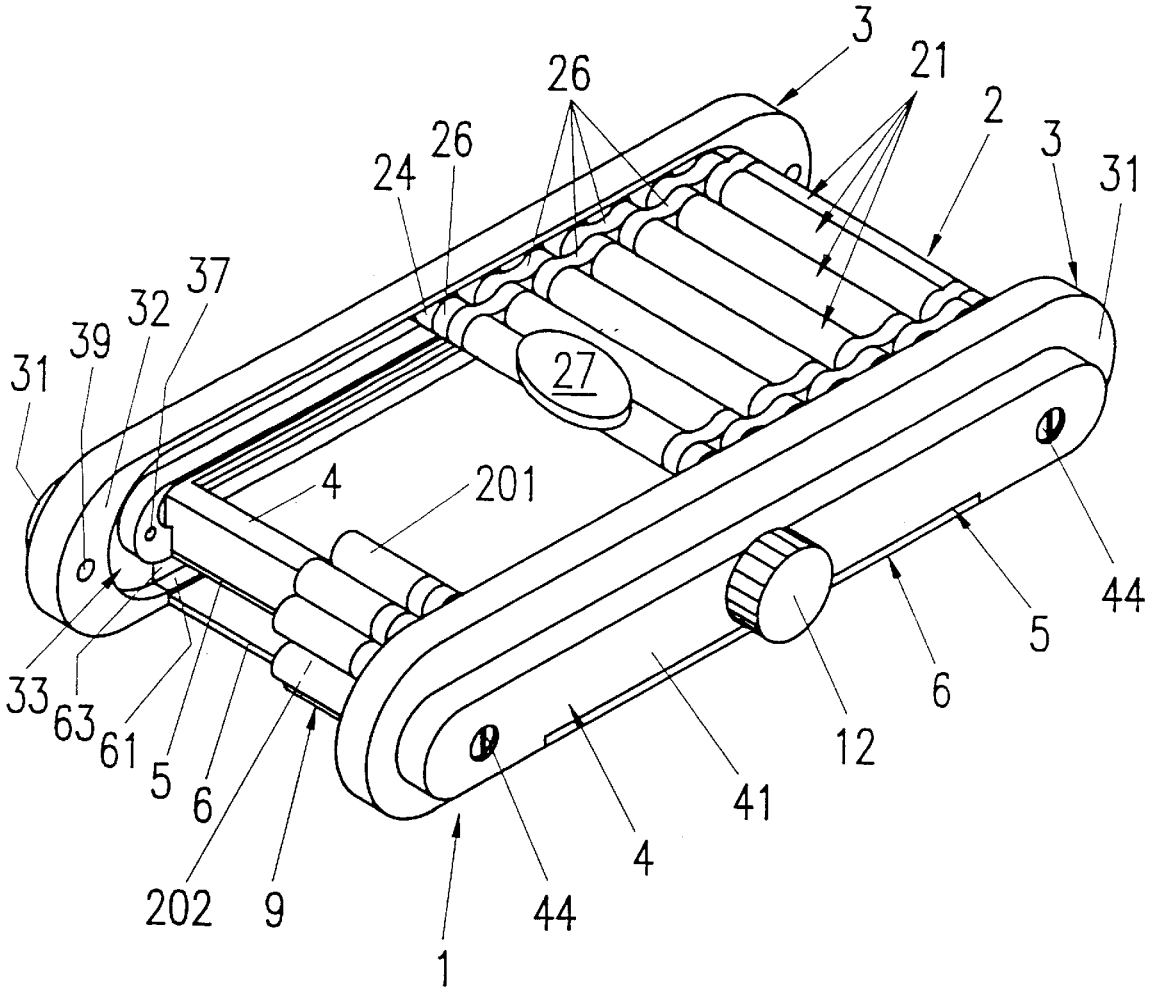
FIG. 1 shows a perspective view of the watch case provided with the movable shutter device.
Figure 2:
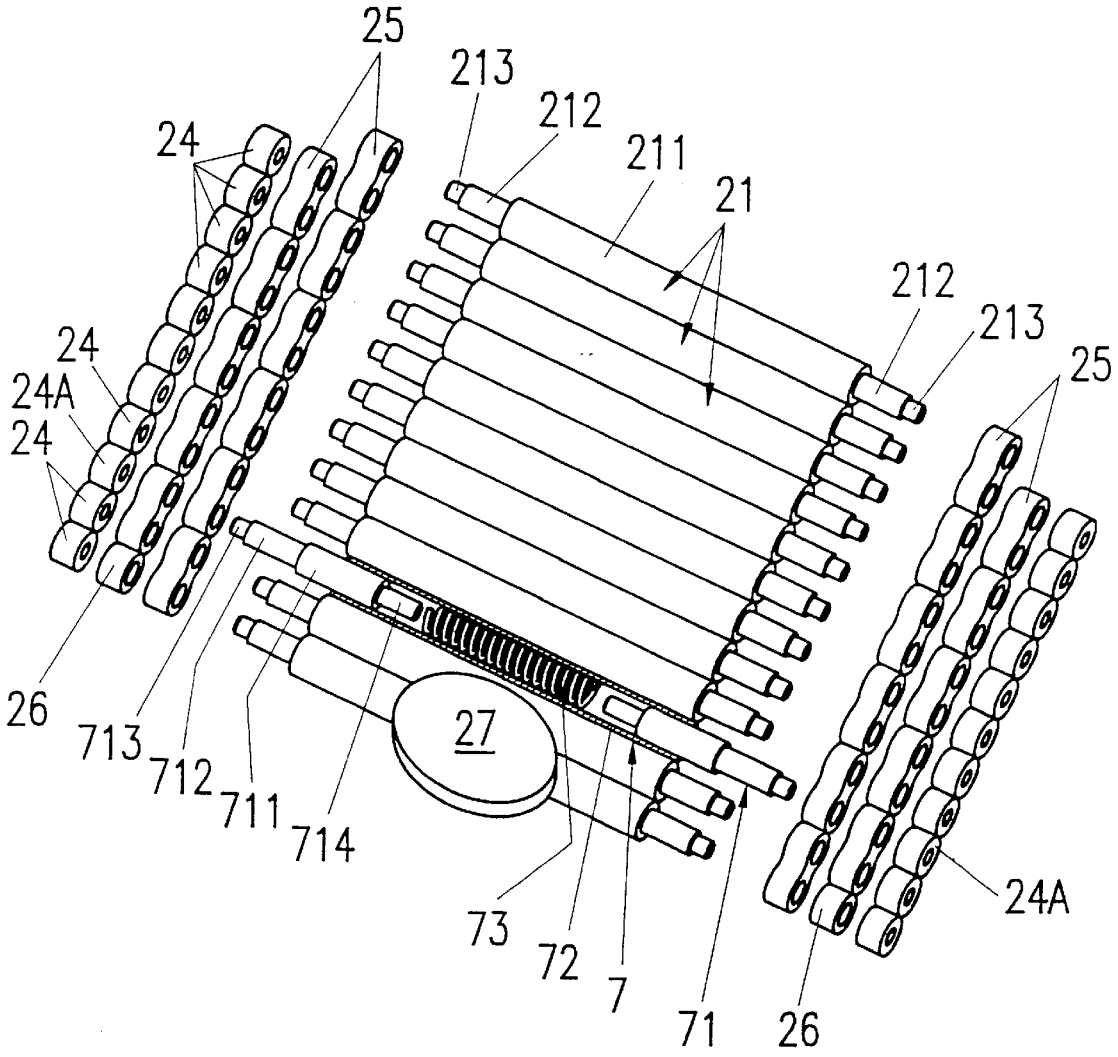
FIG. 2 shows a perspective view of the movable shutter.
Figure 3:
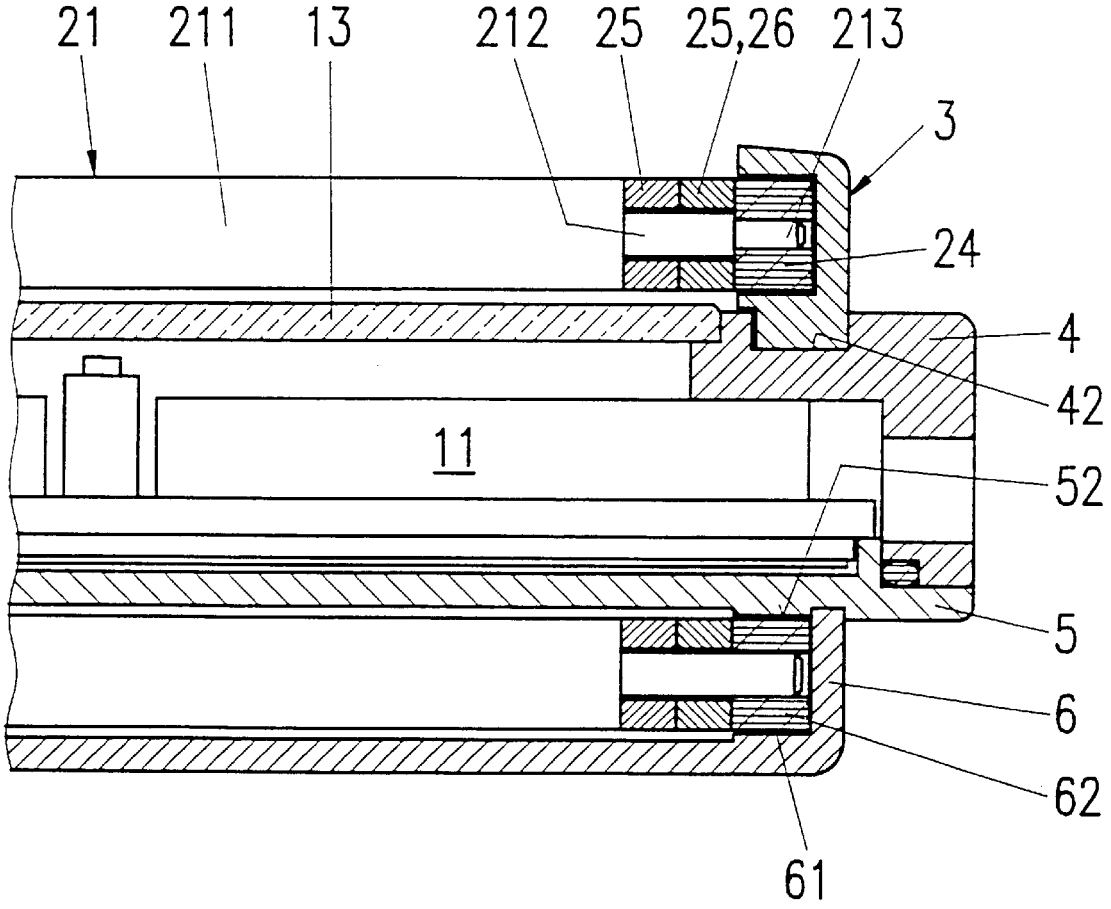
FIG. 3 shows a cross-section according to the 3:00–9:00 plane of the watch including the movable shutter device.

Casing 1 with movable shutter device or supple curtain 2 is composed of a middle 4, a back cover 5 and of a crystal 13, said three elements enclosing a movement 11 to which a winding button 12 is connected, and the device itself comprising two stretchers 3, shutter axles 21 which form the shutter and are interconnected by links 25, as well as bearings 24, a stop device 9, and a protective plate 6 (FIGS. 1, 2, and 3).

Figure 5:
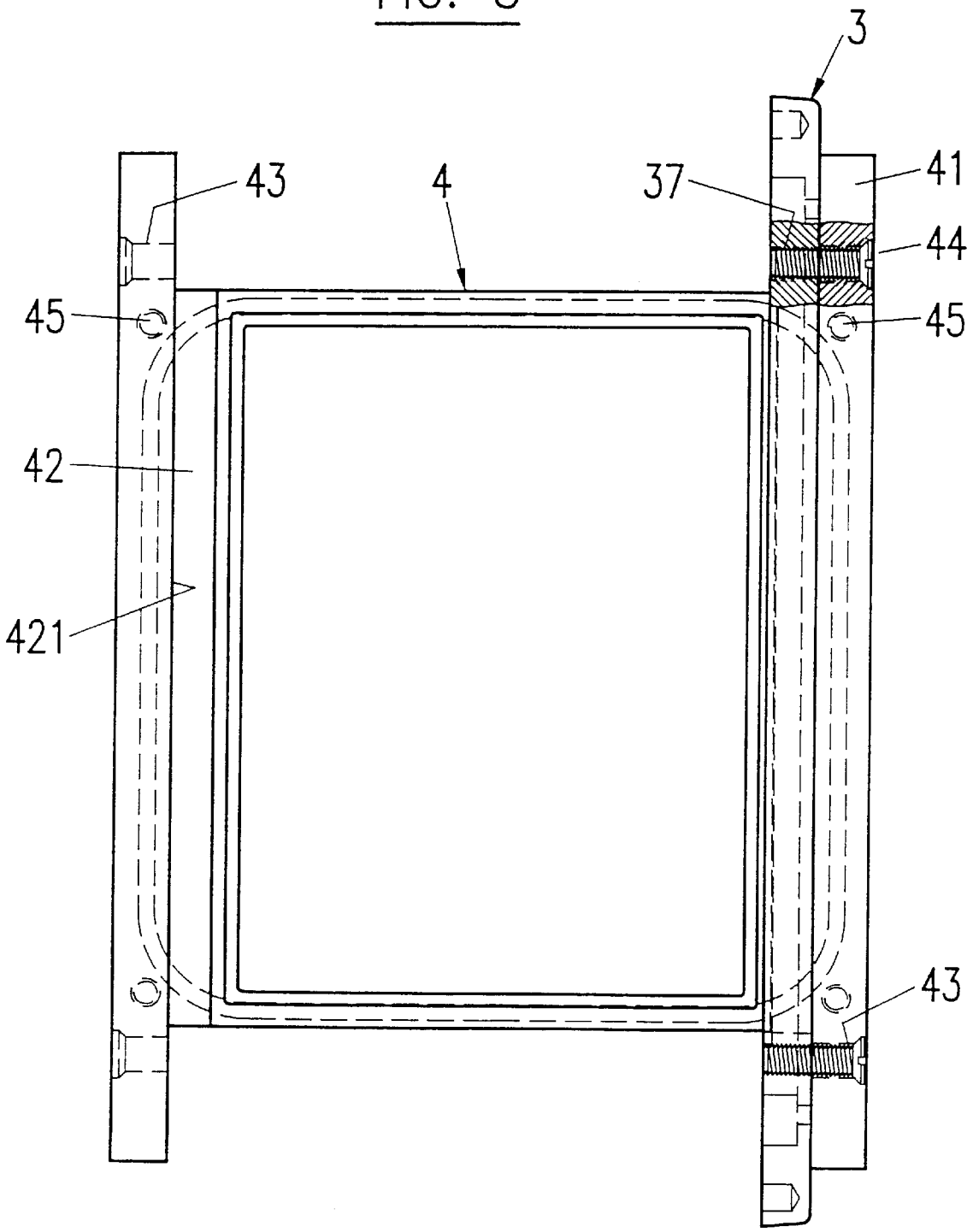
FIG. 5 shows a plan view from above of the middle part with a stretcher.

With reference to FIGS. 1 and 5, it appears that right-hand and left-hand stretchers 3, both of which are identical, extend beyond the middle part and are fixed thereto by screws 44.

Figure 4:
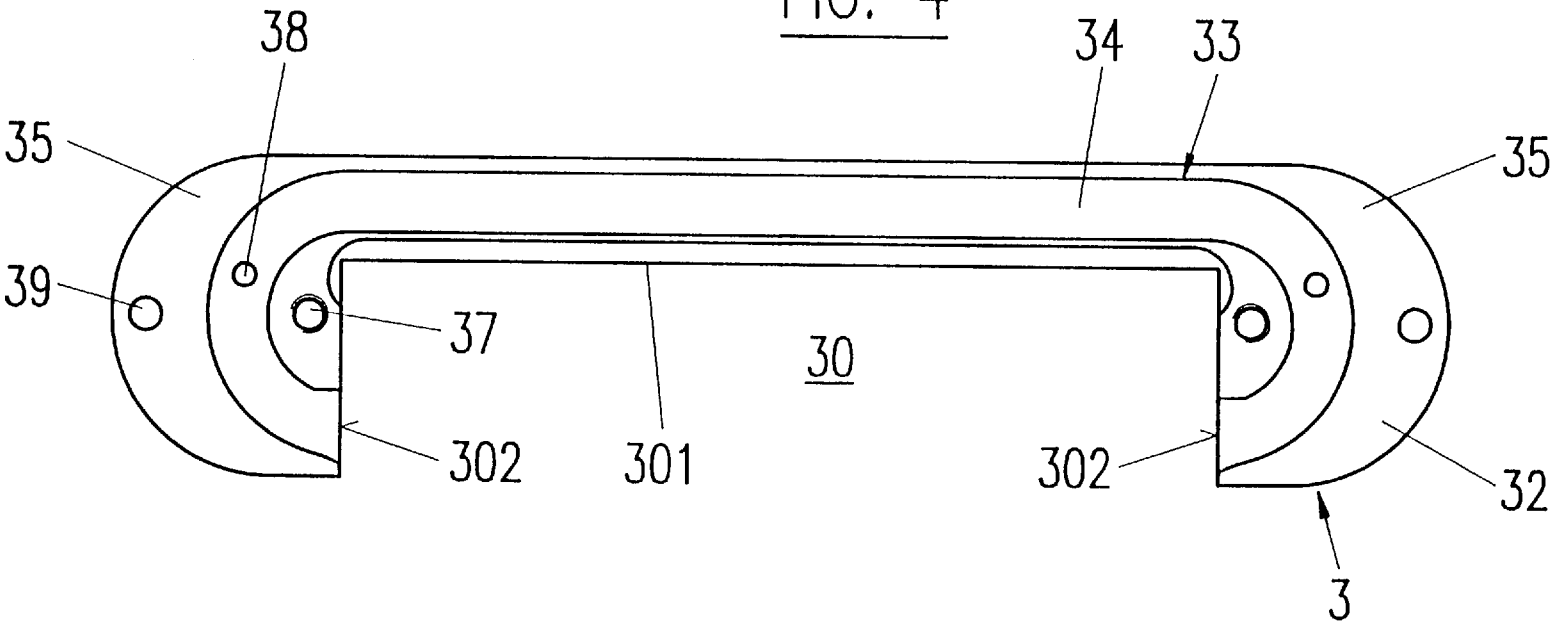
FIG. 4 shows a front view (of the surface facing the inside of the watch) of a stretcher.

Each stretcher 3 has the symmetrical form of an oblong handle with rounded ends (see FIG. 4). A recess 30 is limited by a surface 301 extending in the longitudinal direction and by two surfaces 302 which are perpendicular thereto. Surface 32, which faces the interior of middle part 4, is provided with a guiding groove 33 consisting of a rectilinear portion 34 which is followed on either side by circular portions 35 giving out on recess 30. Finally, each stretcher is provided with two threaded bores 37 which are disposed symmetrically with respect to the non-represented plane of symmetry, with two retaining holes 38 for the purpose of fixing the stop device discussed hereinafter, and with two blind holes 39 intended to receive the ends of a non-represented lug.

Middle part 4 of generally rectangular shape (FIGS. 1 and 5) comprises two lateral flanks 41 extending in the direction of the 6:00–12:00 plane and two adjacent grooves 42 (see also FIG. 3) whose width corresponds to the thickness of stretchers 3. Thus, on both sides of the middle part, a stretcher 3 is fitted to the internal surface 421 of flank 41 and into groove 42, the length of recess 30 of the stretcher corresponding to that of groove 42.

The back cover, which is only shown in cross-section in FIG. 3, also has a generally rectangular form and precisely fits under middle part 4 to which it is fixed by means of screws (not shown), the middle being provided on its underside (not referenced) with four bores 45 (FIG. 5).

Protective plate 6 consists of a rectangular plate whose edges are bent at 90° and parallel to the 6:00–12:00 plane, said edges engaging in two corresponding grooves 51 which are milled in the underside of the back cover. Protective plate 6 is fastened in these grooves of back cover 5 by welding or cementing.

By this precisely effected modular arrangement, two closed circuits for the guidance of the shutter are obtained which face each other. Each circuit extends in a plane which is parallel to the 6:00–12:00 plane and, in a way, surrounds the middle, the two circular groove portions 35 of stretchers 3 being followed by a rectilinear groove portion 63 which is opposed and parallel to groove 34 of stretcher 3 and formed, on one hand, by a flat portion 52 of back cover 5, and on the other hand, by a flat portion 61 and a surface 62 (which is perpendicular to flat portion 61) of protective plate 6 (FIGS. 1 and 3).

The supple shutter is composed of juxtaposed shutter axles 21 whose number is of course a function of their diameter and of the dimensions of the casing. Axles 21, which are preferably made of a single piece, comprise a shutter cylinder 211 both ends of which are followed by a connecting axle 212 whose length corresponds to twice the thickness of a connecting link 25 (see FIG. 3), and by a bearing axle 213 whose length corresponds to the thickness of a roller 24. Axles 21 are assembled on both sides by means of two adjacent rows of connecting links 25 which are fitted on connecting axles 212 and mutually offset in the present example by one step: the internal row of links 25 allows to form a succession of shutter axle pairs while the external row allows, on account of said offset arrangement, to connect said pairs to one another. As appears in FIG. 2, the two end portions of the external row of links are each completed by a half-link consisting of a ring 26.

Finally, an independent roller 24 of a very hard material having a very high self-lubrifying capacity is mounted on each one of the two bearing axles. According to the described embodiment, rollers 24 are formed of rubies, whose properties fulfill these requirements.

The shutter is thus displaceable above crystal 13 (see FIG. 1), in such a manner as to cover the latter or to leave it completely or partially apparent, as desired, the actuation being facilitated by a shutter button 27. The maximum displacement is limited by a known stop device 9 which is formed of a series of stop axles which are similar or identical to shutter axles 21, said stop device comprising an opening abutment 202 (indicated in FIG. 1, but invisible since it is located on the back cover side) and a closing abutment 201, located on the dial side, which may cooperate with button 27 on the first shutter axle of the movable shutter in order to allow to lock the latter in the closed position. Stop device 9 is connected to the stretchers by known means which are not described,. e.g. by engagement of the ends of the stop axles in blind holes 38 of stretchers 3 (FIG. 3).

The shutter is maintained in any position as desired by the wearer, regardless of the movements of the wrist, by means of a brake device 7 (FIG. 2). The latter comprises a tubular element 72 having the same length as cylinders 211, which completely encloses an elastic member 73 (in the present example a worm spring) and partly encloses two brake axles 71 which are disposed on either side of said spring 73. Each brake axle 71 comprises a sliding axle 711 whose diameter corresponds to the internal diameter of tube 72, said sliding axles being followed on one side by a spring axle 714 engaging in spring 73, the latter resting on the shoulder which is formed by the difference in diameter of axles 711 and 714 and, on the other side, by a connecting axle 712 and a bearing axle 713 which are equivalent to connecting axles 212 and to bearing axles 213, respectively. This device is preferably mounted in the front section of the shutter, i.e. near the shutter axle which is provided with button 27. It is understood that elastic member 73 permanently acts upon the two brake axles 711, the latter in turn acting upon ruby rollers 24 A which in this manner press against the surfaces of grooves 33 in stretchers 3 which are parallel to the 6:00–12:00 plane. Of course, the characteristics of elastic member 73 will be selected and defined in function of the desired braking force resulting from said pressure.

Finally, protective plate 6 may be designed as a grating or perforated, in such a manner as to reproduce a logo or a denomination, e.g. the name of the manufacturer or any other sign. It it easily conceivable that the view of the shutter, i.e. of cylinders 211 (which may be adorned with precious stones, as the case may be) passing behind the grating or the perforation produces an esthetic effect of the most refined sort.

The advantages of the device of the invention, as compared to the cited prior art, are easily established:

First, in said prior art shutter, the supports provided with the closed circuit groove were welded onto the middle part. In addition to the imprecision of the welding, its high temperature had the effect of softening the material and modifying the geometry of the parts involving, as mentioned in the introduction, the risk of wear of the shutter, or that of getting stuck or jammed. Conversely, according to the invention, the supports in the form of stretchers are mounted by screwing. Hence, in the first place, they have a higher hardness, whereby the risk of wear is considerably reduced and the precision is increased, and secondly, the access of the mount is simplified due to the dissembling capacity, and finally, the finish can be more elaborate.

Further, the ends of the curtain which are in contact with the grooves are no longer made of gold. In fact, the cylindrical rolls attached to the pins were quickly deformed, so that the operation was less and less satisfactory and more and more irritating. Thanks to the ruby rollers—rubies being characterized by a great gliding capacity and a high wear resistance—the quality of the sliding action is optimum and remains constant.

Finally, the arrangement of a brake device, which is all the more necessary the better the quality of the sliding action, allows to effectively ensure that the curtain is maintained in any desired position. Besides, this device is integrated in the shutter, so that it is visible in no way and does not disturb the appearance of the whole.

We claim:

1. A movable shutter device for a timepiece, wherein the timepiece has a middle part having a crystal over it, an underside below the middle part, a protective plate below the underside of the middle part and spaced slightly therefrom; the underside of the middle part of the timepiece and the protective plate being generally parallel;

the shutter device comprising:

two parallel, lateral supports extending past the middle part of the timepiece, the lateral supports having facing opposed internal surfaces and a respective groove provided in each internal surface;

each of the lateral supports comprises a stretcher mounted onto the top of the middle part of the timepiece and fastened thereto; the groove in the internal surface of each stretcher being opened to receive axles therein; each groove comprising a rectilinear portion in the middle of the stretcher, a respective circular portion at each end of the middle portion and a further groove generally of the shape of the rectilinear portion of the groove located beneath the underside of the middle part and the further groove having a profile dictated by the underside of the middle part of the timepiece and the protective plate spaced below the middle part of the timepiece for guiding axles between the underside of the middle part and the protective plate;

a plurality of shutter axles, each axle having opposite end portions received and guided for movement in the grooves in the internal surfaces of the lateral supports and also in the further grooves; the grooves in the lateral supports being oriented for guiding the axles above and past the crystal in the middle part of the timepiece;

at each internal surface, two adjacent rows of connecting links on the axles, one row of links being an internal row and toward the other internal row and the other row of links at each internal surface being an external row outward of the internal row, the links of the internal row at each internal surface being offset with respect to the links of the external row at the same internal surface by at least one step, each link of the internal row and each link of the external row each uniting at least two adjacent shutter axles, the grooves being so shaped and the axles being of such number that the shutter is formed by the axles being displaceable above the crystal so as to be able to cover the crystal or leave the crystal partially visible or completely visible; and a stop device positioned for limiting the extent of movement of the shutter axles along the grooves for establishing maximum displacements of the shutter axles.

2. The movable shutter device of claim 1, wherein there is an imaginary plane through the timepiece at 6:00–12:00 and the lateral supports extend parallel to each other and to the 6:00–12:00 plane.

3. The movable shutter device of claim 1, wherein the middle part of the timepiece includes two lateral flanks parallel to the 6:00–12:00 plane and the middle part includes two seats also extending in the same direction; the stretcher being mounted on top of the middle part of the timepiece in the seats where the stretchers are fastened to the middle part.

4. The movable shutter device of claim 1, wherein the stop device comprises cylinders that are similar in shape to the axles and are positioned for being engaged by the shutter axles at a position where the shutter axle should be stopped; the stop device further comprising an opening abutment and a closing abutment;

a shutter button leading one of the axles at the front of the movable shutter to lock to the closing abutment for locking the shutter axles in the closed position over the crystal.

5. A movable shutter device for a timepiece, wherein the timepiece has a middle part having a crystal over it and having an underside below the middle part, the shutter device comprising:

two parallel, lateral supports extending past the middle part of the timepiece, the lateral supports having facing opposed internal surfaces and a respective groove provided in each internal surface;

a plurality of shutter axles, each axle having respective opposite end portions received and guided for movement in the grooves in the internal surfaces of the lateral supports, the grooves being oriented for guiding the axles above and past the crystal in the middle part of the timepiece;

at each internal surface, two adjacent rows of connecting links on the axles, one row of links being an internal row and toward the other internal row and the other row of links at each internal surface being an external row outward of the internal row, the links of the internal row at each internal surface being offset with respect to the links of the external row at the internal surface by at least one step, each link of the internal row and each link of the external row each uniting at least two adjacent shutter axles, the grooves being so shaped and the axles being of such number that the shutter is formed by the axles being displaceable above the crystal so as to be able to cover the crystal or leave it partially visible or completely visible;

a stop device positioned for limiting the extent of movement of the shutter axles along the grooves for establishing maximum displacements of the shutter axles;

each of the shutter axles comprises a centrally located cylinder having on each side thereof a connecting axle on which both the internal and external row links are carried and having a bearing axle outward of the connecting axle and which is received in the respective groove in the respective lateral support;

each bearing axle supporting an independent roller within the groove and the roller being comprised of a noble material having a very high hardness and a very high lubrifying capacity.

6. A movable shutter device for a timepiece, wherein the timepiece has a middle part having a crystal over it and having an underside below the middle part, the shutter device comprising:

two parallel, lateral supports extending past the middle part of the timepiece, the lateral supports having facing opposed internal surfaces and a respective groove provided in each internal surface;

a plurality of shutter axles, each axle having respective opposite end portions received and guided for movement in the grooves in the internal surfaces of the lateral supports, the grooves being oriented for guiding the axles above and past the crystal in the middle part of the timepiece;

at each internal surface, two adjacent rows of connecting links on the axles, one row of links being an internal row and toward the other internal row and the other row of links at each internal surface being an external row outward of the internal row, the links of the internal row at each internal surface being offset with respect to the links of the external row at the internal surface by at least one step, each link of the internal row and each link of the external row each uniting at least two adjacent shutter axles, the grooves being so shaped and the axles being of such number that the shutter is formed by the axles being displaceable above the crystal so as to be able to cover the crystal or leave it partially visible or completely visible;

a stop device positioned for limiting the extent of movement of the shutter axles along the grooves for establishing maximum displacements of the shutter axles;

a brake device on one of the shutter axles for being operated to so engage the respective shutter axle in the groove for braking movement of the shutter axles along the groove.

7. The movable shutter device of claim 6, wherein the stop device comprises cylinders that are similar in shape to the axles and are positioned for being engaged by one of the shutter axles at a position where the shutter axles should be stopped; the stop device further comprising an opening abutment and a closing abutment; a shutter button leading one of the shutter axles at the front of the movable shutter to lock to the closing abutment for locking the shutter axles in the closed position.

8. The movable shutter device of claim 6, wherein the shutter axle including the brake is a hollow shutter axle and the brake device is accommodated in the hollow shutter axle.

9. The movable shutter device of claim 8, wherein the hollow shutter axle is a hollow cylinder;

the brake device comprises an elastic member accommodated in the hollow cylinder; respective brake axles at both ends of the hollow cylinder communicating with the elastic member for being urged outwardly of the cylinder by the elastic member;

a respective bearing axle outward of each brake axle and received in each of the grooves in the lateral supports, and the bearing axles being comprised of a noble material having a very high hardness and a very high self-lubrifying capacity, and the elastic member acting on the bearing axles urging them into the groove into contact with the internal support.

* * * * *

UNITED STATES PATENT AND TRADEMARK OFFICE

CERTIFICATE OF CORRECTION

PATENT NO. : 5,805,535

DATED : Sep. 8. 1998

INVENTOR(S) : Jean-Pierre GUYARD et al.

It is certified that error appears in the above-identified patent and that said Letters Patent is hereby corrected as shown below:

On the title page:

change the name of the Assignee at Item [73] to read --Fabrique de montres Delaneau SA, Switzerland--.

Signed and Sealed this

Twenty-fourth Day of August, 1999

*Attest:*

Q. TODD DICKINSON

*Attesting Officer*

*Acting Commissioner of Patents and Trademarks*